United States Patent [19]

Hayashi

[11] 4,353,315

[45] Oct. 12, 1982

[54] STEP GRATE FOR MECHANICAL STOKER WITH FLEXIBLE FIRE GRATE

[75] Inventor: Katsurou Hayashi, Fujisawashi, Japan

[73] Assignee: Akihiko Hiroe, Fujisawa, Japan

[21] Appl. No.: 158,774

[22] Filed: Jun. 12, 1980

[30] Foreign Application Priority Data

Jun. 14, 1979 [JP] Japan ..... 54-075162

[51] Int. Cl.[3] ..... F23H 7/08

[52] U.S. Cl. ..... 110/281; 110/273; 110/329; 198/630

[58] Field of Search ..... 110/269, 273, 274, 291, 110/329, 268, 101 R, 101 A, 327, 281, 282, 283; 198/630

[56] References Cited

U.S. PATENT DOCUMENTS 1,958,322 5/1934 Symington ..... 198/630 X
4,200,047 4/1980 Knorr ..... 110/268 X

FOREIGN PATENT DOCUMENTS 1902937 8/1970 Fed. Rep. of Germany ..... 110/281
1934205 1/1971 Fed. Rep. of Germany ..... 110/281

*Primary Examiner*—Edward G. Favors
*Attorney, Agent, or Firm*—Cushman, Darby & Cushman

[57] ABSTRACT

A flexible, perforate grate, e.g. made of a mat of meshed metal chain links or wirecloth belting, is provided at intervals spaced across its length, with individually extensile/retractile supports. By coordinately extending and retracting the supports, the material fed onto the grate at one margin can be walked, rolled, tumbled and similarly redistributed and moved across the grate to the opposite margin, and, for instance dumped off the far edge of the grate into a residue collecting system. The grate may be basically horizontal, or it may have a general cascade-like tilt either forwards or rearwards. In one embodiment, the supports are seen each having a grate mat contact member which pivots during extension and retraction in order to further alter the shape of the grate mat intervening two adjacent supports.

11 Claims, 15 Drawing Figures

STEP GRATE FOR MECHANICAL STOKER WITH FLEXIBLE FIRE GRATE

BACKGROUND OF THE INVENTION

In the incineration of garbage, sludge, low grade solid fuel or the like, it is known to provide a fire grate with a stoker that feeds combustible material onto the grate, spreads it, and removes the solid combustion product residue off the grate in order to manage the combustion process.

SUMMARY OF THE INVENTION

A flexible, perforate grate, e.g. made of a mat of meshed metal chain links or wirecloth belting, is provided at intervals spaced across its length, with individually extensile/retractile supports. By coordinately extending and retracting the supports, the material fed onto the grate at one margin can be walked, rolled, tumbled and similarly redistributed and moved across the grate to the opposite margin, and, for instance dumped off the far edge of the grate into a residue collecting system. The grate may be basically horizontal, or it may have a general cascade-like tilt either forwards or rearwards. In one embodiment, the supports are seen each having a grate mat contact member which pivots during extension and retraction in order to further alter the shape of the grate mat intervening two adjacent supports.

The principles of the invention will be further discussed with reference to the drawings wherein preferred embodiments are shown. The specifics illustrated on the drawings are intended to exemplify, rather than limit, aspects of the invention as defined in the claims.

BRIEF DESCRIPTION OF THE DRAWINGS

FGS. 1–3 are fragmentary side elevation views of a descending step grate provided with a mechanical stoker in accordance with principles of the present invention.

DETAILED DESCRIPTION

Figure 14:
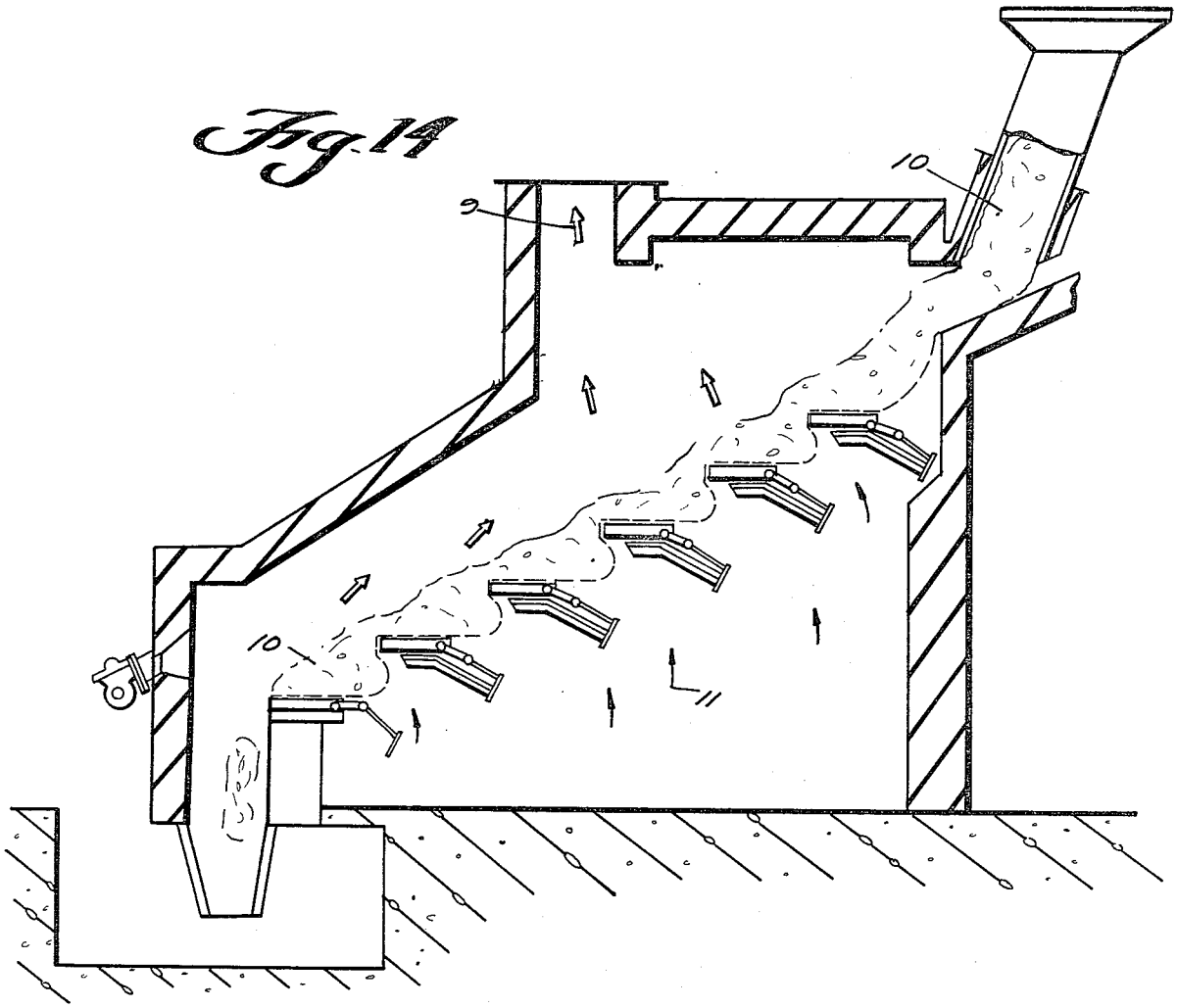
FIG. 14 is a side elevation view of a furnace provided with a descending step grate having a mechanical stoker provided in accordance with principles of the present invention.

Referring first to FIG. 14, there is shown a furnace having a descending step grate. Combustion air is supplied from below, as at 11. Fuel is dispensed onto the rightmost, upper margin of the grate from a hopper, and is burned as it travels toward the residue collecting trough at the leftmost, lower margin of the grate. The combustion gases pass off at 9 after passing upward along the fuel, aiding incineration and completeness of combustion. The purpose of the apparatus of the invention is to facilitate management of the travel of the solid fuel 10.

Figure 1:
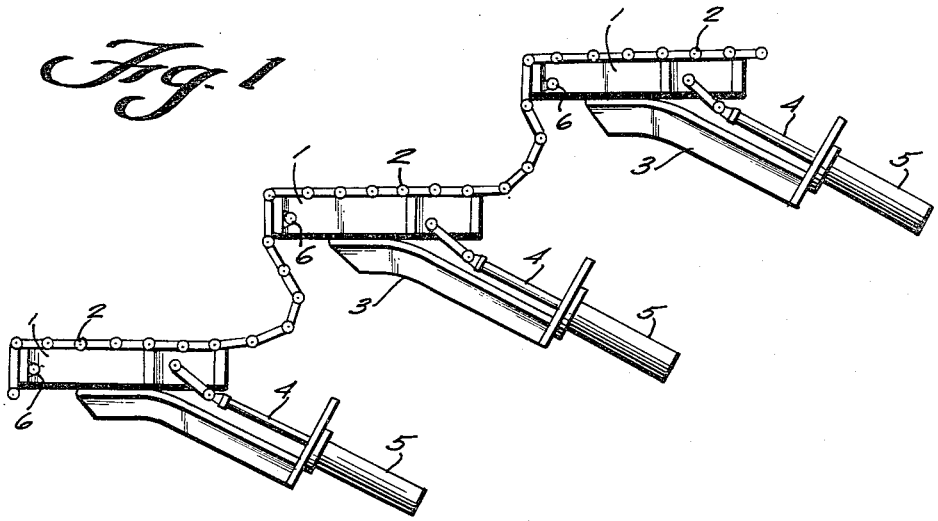
Figure 2:
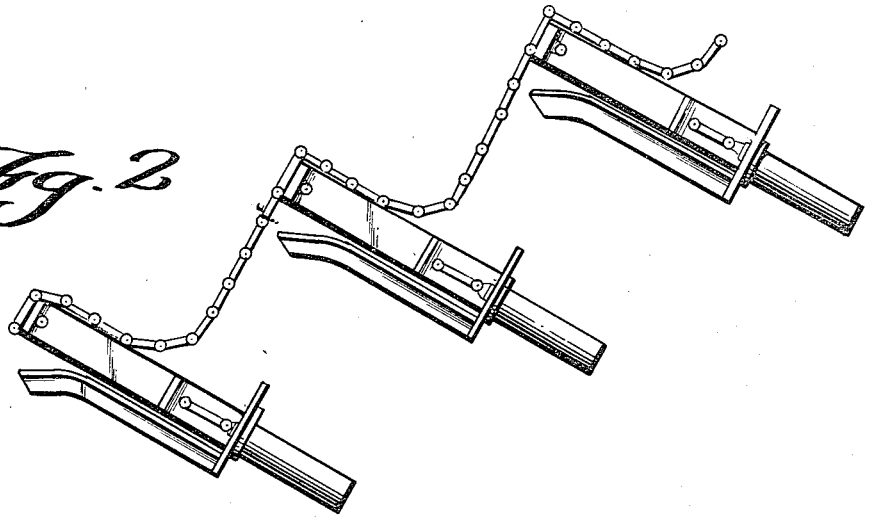
Figure 3:
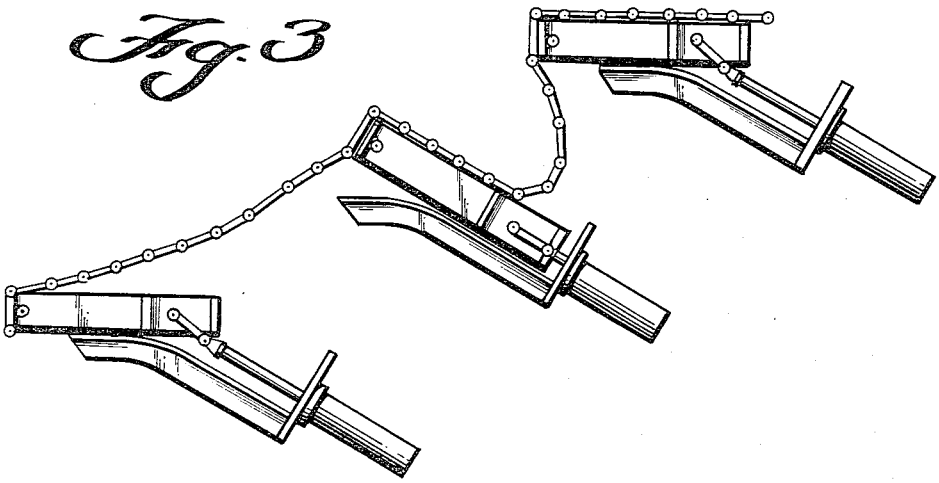

In FIGS. 1–3, an intermediate part of the step grate of FIG. 14 is shown in more detail, together with the corresponding elements of the stoker of the invention.

The numeral 2 designates the grate per se. It may be constructed of conventional wire cloth, chain mail, meshed chain links or the like to constitute a perforate, reticulated, durable flexible fabric suitable for supporting the material that is to be burned. The grate is typically rectangular, and of a length and width sized to the particular installation.

Figure 15:
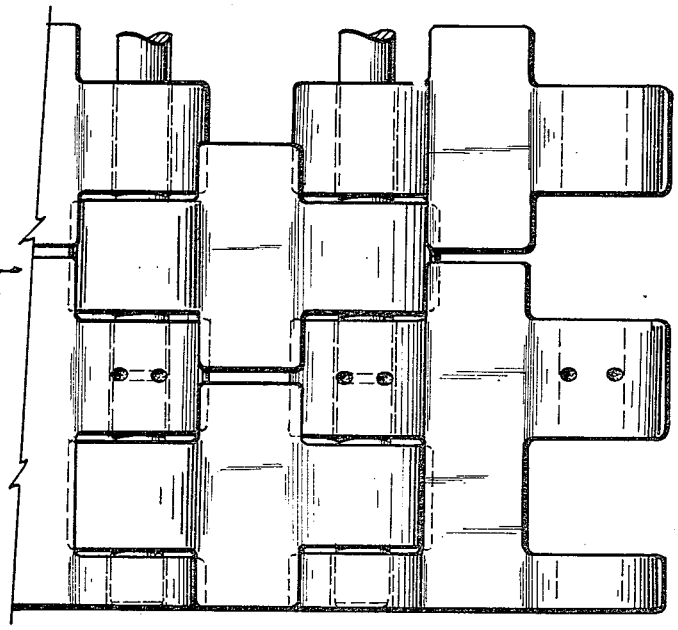
FIG. 15 is a fragmentary plan view illustrating the typical appearance of the grate fabric.

A typical appearance of the flexible grate material is illustrated in FIG. 15.

Beneath the grate 2 in FIGS. 1–3 are a plurality of generally upwardly projecting support structures. Three of these in one row are shown in each of FIGS. 1–3, but in practice a grate would be provided with a larger number, depending on its length and if the grate were wide, a second row or more of like support structures could be provided. Each of the support structures is shown projecting towards the downstream margin of the grate as it projects upwards, e.g. each projects obliquely up and to the left as seen in FIGS. 1–3.

Within the same row of support structures in FIGS. 1–3, proceeding leftwards, each is disposed somewhat lower than its preceding neighbor, and there is an interval between each two support structures in the same row.

Each support structure comprises a fixed support adapted to be suitably mounted in a furnace or the like as generally illustrated in FIG. 14, and having a rail 3 which protrudes obliquely upwards and to the left, then curves to proceed more horizontally to the left. Slidingly supported on the rail 3 is a grate contact member, in this instance a carriage 1. The grate 2 is draped over the supports so as to hang in a trough-like catenary in the interval between each two neighboring support structures. At 6, the grate 2 is pinned to each grate contact member 1 along the downstream marginal edge of the respective grate contact member 1.

At a location near its upstream marginal edge, each grate contact member is pivoted to the outer end of a reciprocating rod structure 4 which is movably mounted to the respective fixed support 5. In the instance depicted, the fixed support 5 comprises a cylinder of a fluid pressure-operated piston/cylinder arrangement and the rod structure 4 comprises the piston rod of a piston (not shown) slidably mounted in the aforementioned cylinder. Control lines (not shown) are fitted to the cylinders, so that each may be operated manually or automatically, coordinately or entirely individually extend and retract the piston rods 4.

In FIG. 1, all the piston rods 4 are in a fully thrust condition. This slides the carriages 1 up and leftward on the rails 3, until each carriage 1 is resting on the generally horizontal upper end portion of the respective rail. Note the shape of the cascade of the grate 1.

In FIG. 2, all the piston rods 4 are in a fully retracted condition. This slides the carriages 1 down and rightward on the rails 3, until each carriage 1 is resting on the generally inclined downstream, oblique lower portion of the respective rail 3. Note the shape of the cascade of the grate 1.

In FIG. 3, the most central piston rod is fully retracted, while the other two are fully thrust, causing the leftmost catenary of the flexible grate 2 to be broad and shallow while the rightmost catenary thereof is narrow and deep. These catenaries may be thought of as stages in the transport of fuel across the grate.

FIGS. 4–7 illustrate how thrusting and retracting of the piston rods 4 can be used to distribute and move fuel across the grate from stage to stage.

Figure 4:
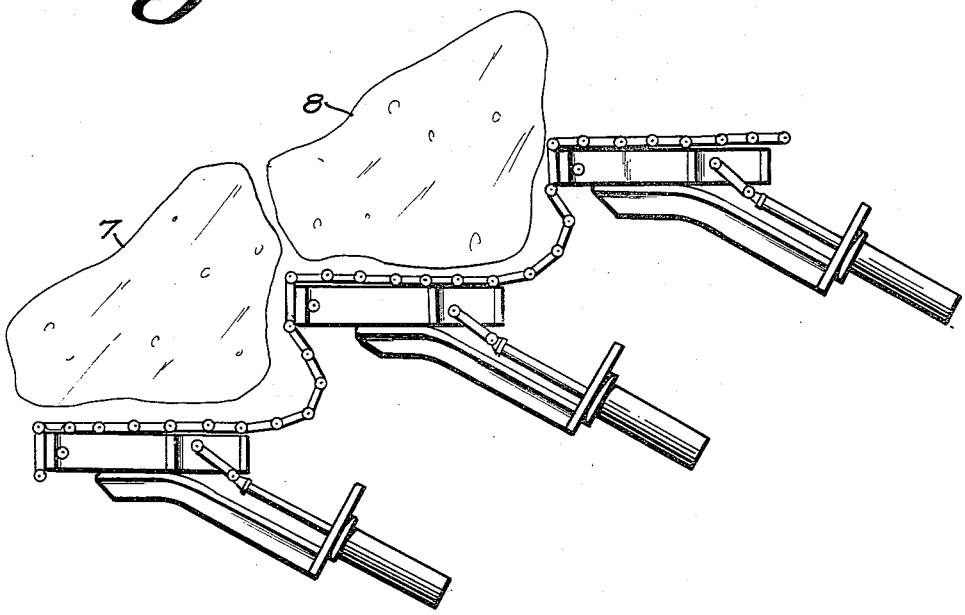
FIGS. 4–7 are a succession of fragmentary side elevation views of the FIGS. 1–3 apparatus, showing stages in the travel of fuel across the grate due to operation of the mechanical stoker.

In FIG. 4, all of the rods 4 are fully thrust. Clumps of fuel are shown disposed on upper and lower stages at 8 and 7, respectively.

Figure 5:
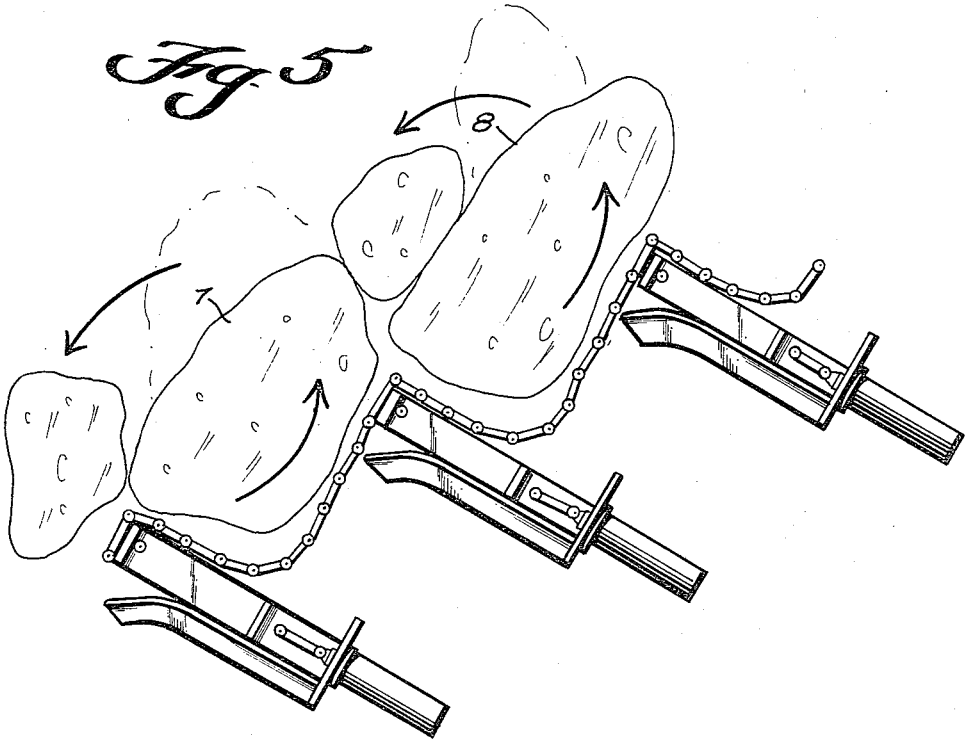

FIG. 5 shows what typically happens when all the rods 4 are fully retracted from their FIG. 4 fully thrust dispositions. The clumps 7 and 8 of the fuel are caused to rotate, as indicated by the arcuate arrows in FIG. 5, which causes upper, upstream portions of the fuel clumps to become unstably elevated, break off, and fall fowards and down to respective downstream stages. This exposes to the air for burning, parts of the fuel clumps that formerly were hidden inside the clumps.

Figure 6:
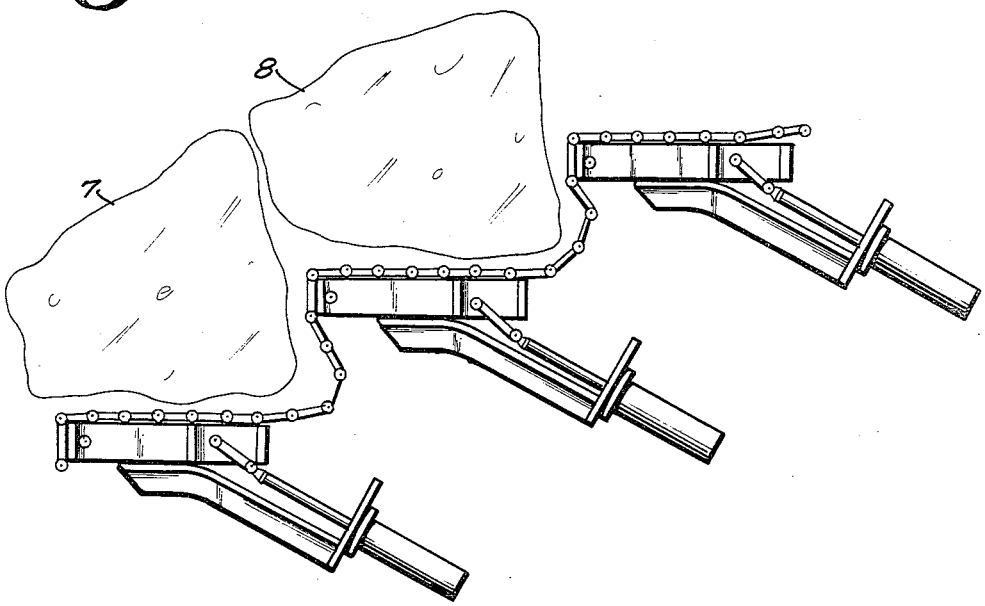
Figure 7:
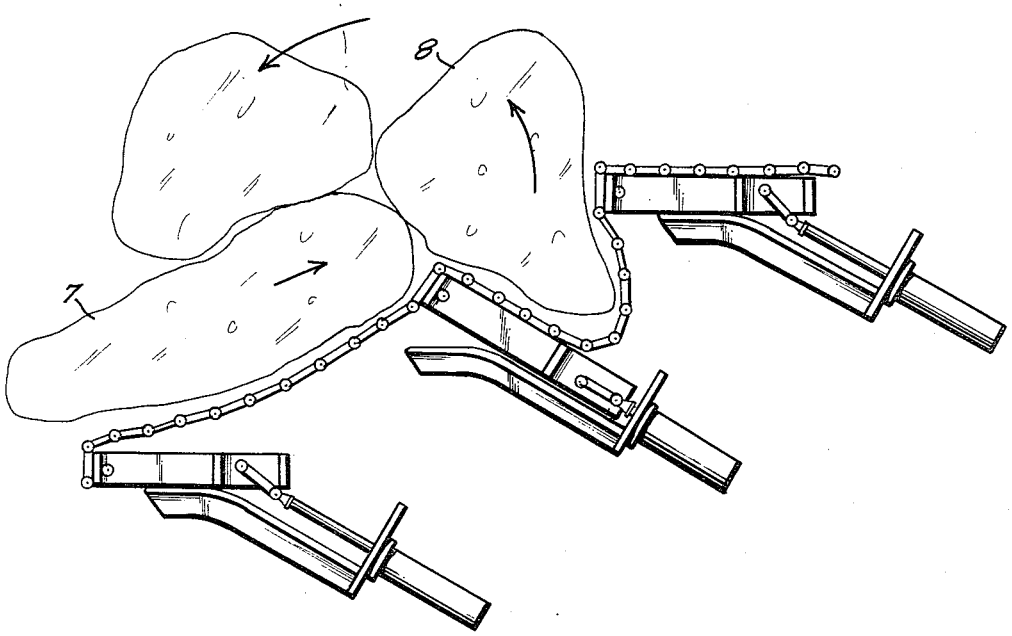

In FIG. 6, the rods 4 have been thrust to their FIG. 4 positions again and in FIG. 7 the rod 4 of the central support structure only has been retracted, causing another sub-clump of the fuel clump 8 to break off and roll down onto the clump 7 which is supported in a broad, flattened catenary of the flexible grate 2.

FIGS. 4–7 thus show how the support structures can be manipulated to thicken and thin the fuel blanket supported on the flexible grate, and to advance the fuel toward the exit margin of the flexible grate.

In FIGS. 4–7 the support structures and thus the flexible grate are in a particular arrangement, i.e. a descending cascade from entrance margin to exit margin of the flexible grate. A different embodiment is illustrated in FIGS. 8–13. Here, the five support structures illustrated each have a similar orientation, i.e. each extends obliquely up to the left, but all except the one located furthest downstream (next to the residue collecting trough and auger) are at a common horizontal level. The latter support structure is shown being disposed somewhat below the rest.

Figure 8:
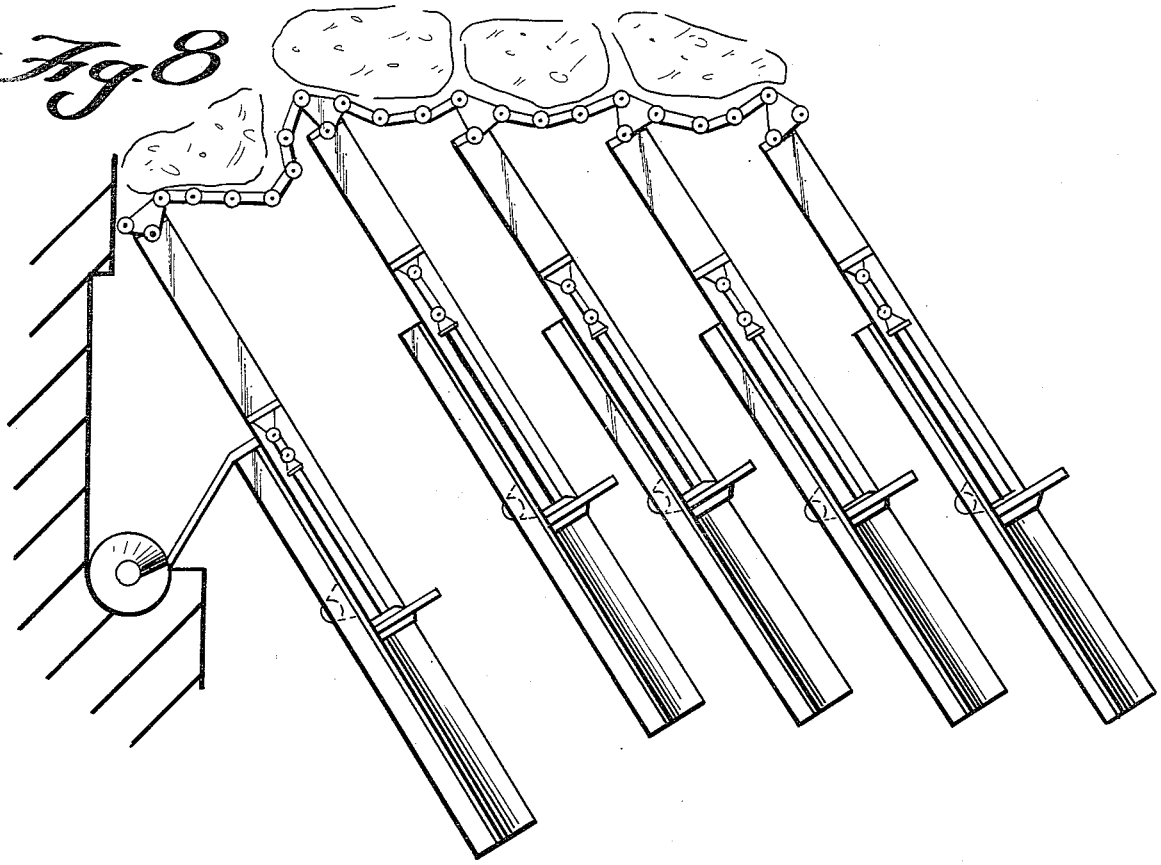
FIGS. 8–13 are a succession of views of a second embodiment showing a succession of stages in the operation of this embodiment for transferring the fuel across the grate due to operation of the mechanical stoker.

Another difference in the FIGS. 8–3 embodiment is that the carriage support rails are straight, i.e. oblique from bottom to top, with no outer horizontal portion, so the carriages are not tilted from oblique to horizontal when the piston rods are thrust.

Once again, the purpose of thrusting and retracting the piston rods in FIGS. 8–13 is to distribute fuel (not shown) carried in a blanket on the flexible grate, and to gradually move the fuel toward the left as it burns, and to finally dump the residue in the auger trough at the left.

In FIG. 8, the piston rods are all fully thrust, the flexible grate is generally flat, except that there is a trough catenary at the downstream exit margin of the grate, which overlies the auger trough. The end wall of the furnace helps complete the catenary trough.

Figure 9:
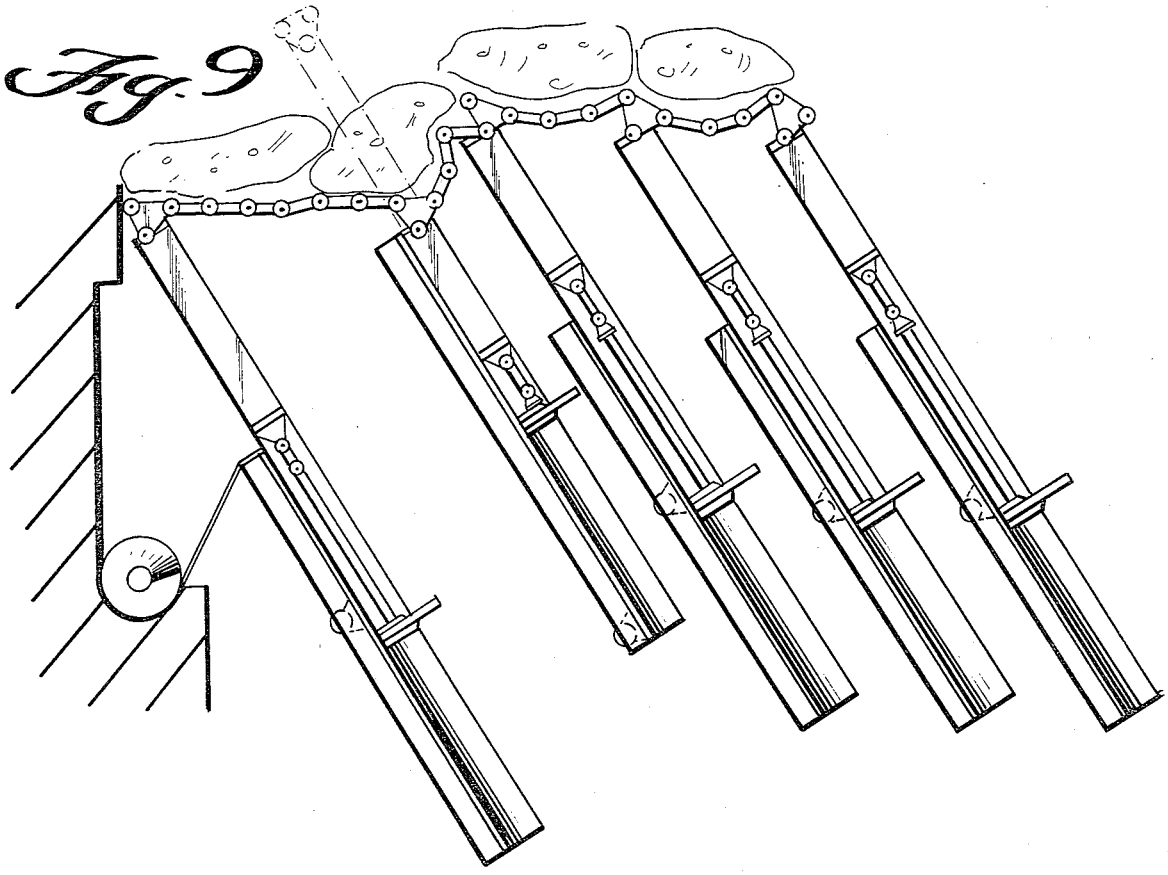

In FIG. 9, the next-to-last piston is retracted, and all the others remain extended as they were; this creates a double-interval catenary into which fuel may fall from the former next-to-last catenary. Fuel is similarly transferred one stage forwards by progressively retracting the rods stage-by-stage proceeding upstream from the next-to-last, until all but the furthest to the left are retracted, as shown in FIG. 10.

Figure 11:
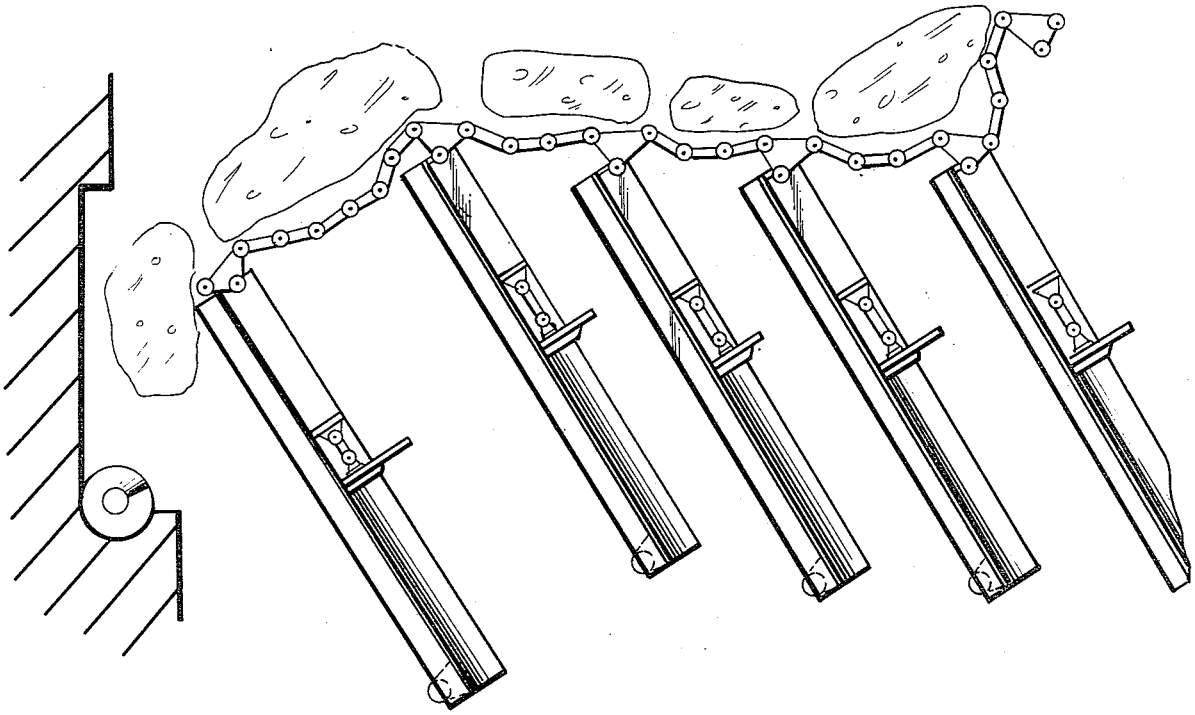

Retraction of the furthest rod to the left dumps much of the contents of the respective catenary into the auger trough (see FIG. 11).

Figure 10:
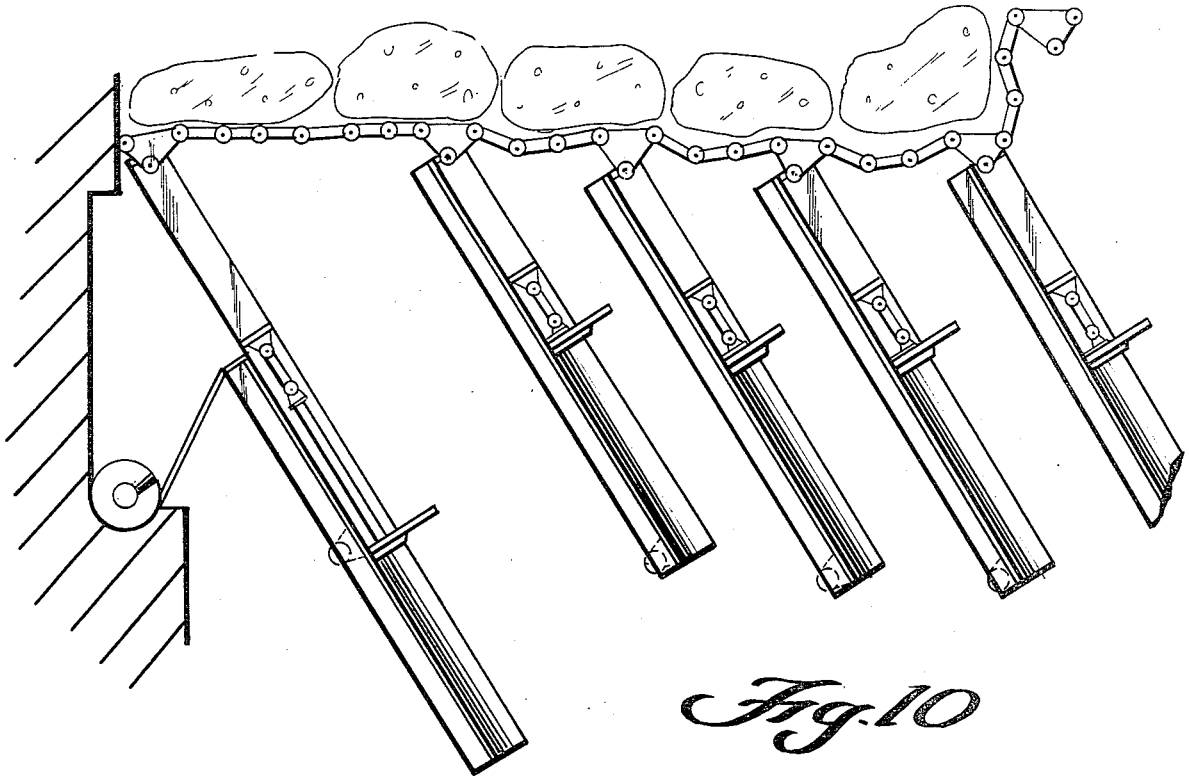
Figure 12:
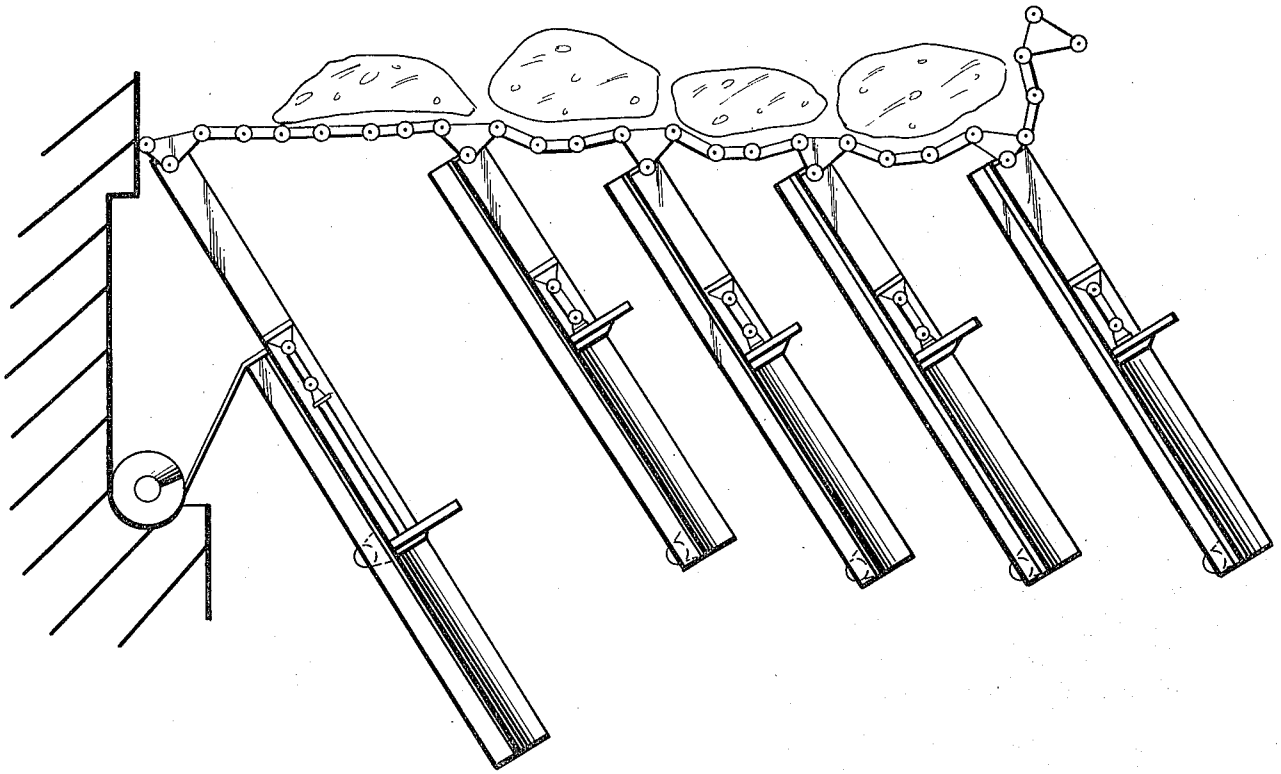
Figure 13:
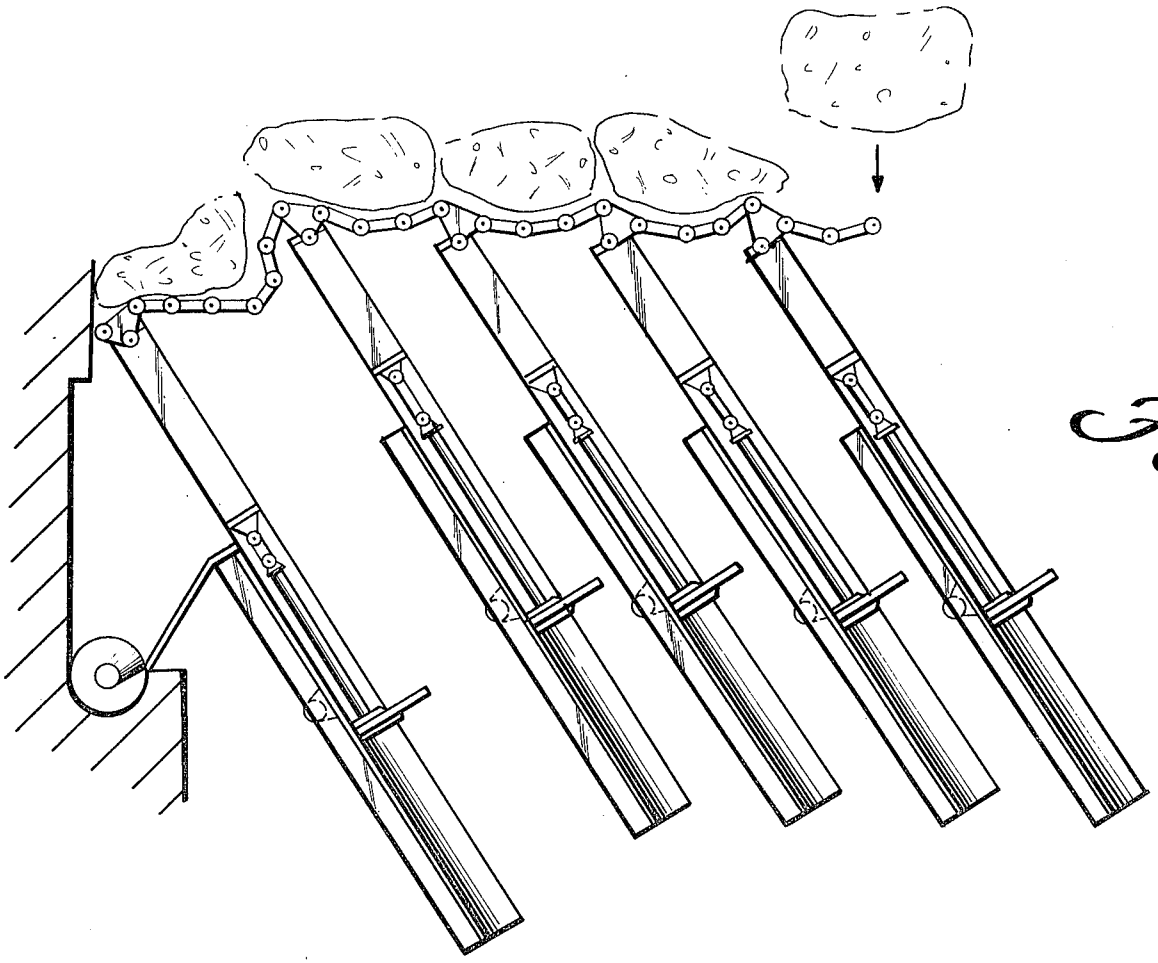

In FIG. 12, the auger trough has been recovered by thrusting the piston rod of the furthest downstream support structure (i.e. the FIG. 10 support structure dispositions exist once more). Next, all the rods, but the one already thrust, are thrust again to provide the FIG. 13 dispositions (which replicates the FIG. 8 dispositions). Thus, fuel is moved forwards from the entrance margin of the grate to the exit margin of the grate in a pattern of troughs and swells that, in a way, mimics the action of an incoming tide bringing flotsam up onto a beach.

Depending on how the support structures are oriented and successively operated, a fuel blanket may be migrated down a cascade, across a flat plane or even uphill.

While the present invention was developed to convey fuel across a furnace grate, it should be apparent that the invention has broader applicability in effecting the forced migration of a blanket in a selected direction, om a flexible, supporting, conveyor surface which does not itself translate, but rather oscillates by stages.

Generally, the reciprocation axes of the rods 4 of the support structures are tilted in the direction that the blanket is to be migrated. Although pressurized fluid-operated piston/cylinder arrangements are one way that the support structures can be operated to thrust and retract the rods 4, other means may be employed, such as cammed purely mechanical movements.

It should now be apparent that the step grate mechanical stoker with flexible fire grate as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A step grate mechanical stoker, comprising:

a flexible reticulate grate having an entrance margin and an exit margin, said grate being generally laid out so that material may be loaded onto the grate at the entrance margin and migrated across the grate to the exit margin;

a plurality of generally upright support structures arranged in at least one series;

said grate being draped upon said support structures so that said series is aligned with the entrance margin to exist margin dimension of said grate and said grate being constituted between adjacent twos of said support structures by a respective plurality of flexibly interconnected elements so that said grate hangs in respective cantenaries in respective intervals between pairs of neighboring said support structures in said series.

each support structure including a grate contact member, a fixed portion, and an extensible/retractible portion between the contact member and fixed portion thereof;

means for extending and retracting each extensible/-retractible portion.

2. The step grate mechanical stoker of claim 1, wherein:

each extensible/retractible portion of each support structure is arranged to extend and retract along an axis which is inclined towards said exit margin.

3. The step grate mechanical stoker of claim 2, wherein:

each grate contact member, when the associated support structure extensible/retractible portion is fully extended in use is at the same level as the others of said grate contact members.

4. The step grate mechanical stoker of claim 2, wherein:

each grate contact member, when the associated support structure extensible/retractible portion is fully retracted in use is at the same level as the others of said grate contact members.

5. The step grate mechanical stoker of claim 1, wherein:

said grate is generally horizontal.

6. The step grate mechanical stoker of claim 1, wherein:

said grate is arranged on a decline which generally cascades from the entrance margin thereof to the exit margin thereof.

7. The step grate mechanical stoker of claim 1, wherein:

the grate is constituted by a two-dimensional fabric of meshed metal chain links.

8. The step grate mechanical stoker of claim 1, further comprising:

means securing each grate contact member to the grate.

9. The step grate mechanical stoker of claim 8, wherein:

each support structure fixed portion includes a track on which the respective grate contact member is shiftably supported, so that as the respective extensible/retractible portion extends and retracts the respective grate contact member moves in supported, guided relation with the respective track.

10. The step grate mechanical stoker of claim 9, wherein:

each track has a lower inclined portion curvingly joined to an upper horizontal portion, so that each grate contact member is moved angularly between an inclined and a horizontal position as it is moved up and down along the respective track.

11. The step grate mechanical stoker of claim 10, wherein:

each grate contact member comprises a carriage which has a more widespread area in contact with the grate when such carriage is in said horizontal position than when said carriage is in said inclined position.

* * * * *